United States Patent [19]

Peterson

[11] 3,988,859

[45] Nov. 2, 1976

[54] ENTRY STRUCTURE AND AIR-OPERATED LOCK THEREFOR

[75] Inventor: Francis C. Peterson, St. Louis County, Mo.

[73] Assignee: C. Hager & Sons Hinge Manufacturing Company, St. Louis, Mo.

[22] Filed: Dec. 18, 1974

[21] Appl. No.: 533,961

[52] U.S. Cl. ..... 49/394; 292/201; 292/227

[51] Int. Cl.[2] ..... E05B 65/05; E05C 3/10

[58] Field of Search ..... 49/394, 302, 272; 70/275; 292/201, 229, 227, 237, 226, DIG. 71

[56] References Cited

UNITED STATES PATENTS

| | | | |
|---|---|---|---|
| 518,119 | 4/1894 | Schnepf | 292/201 |
| 2,093,201 | 9/1937 | Love | 49/167 |
| 2,212,563 | 8/1940 | Groeger | 292/DIG. 71 |
| 2,726,893 | 12/1955 | Zucker | 49/302 |
| 3,377,092 | 4/1968 | Rohman | 292/229 |
| 3,722,938 | 3/1973 | Bauer et al. | 292/92 |
| 3,872,541 | 3/1975 | Peterson | 16/137 |

FOREIGN PATENTS OR APPLICATIONS

| | | | |
|---|---|---|---|
| 603,561 | 4/1960 | Italy | 292/201 |

*Primary Examiner*—Casmir A. Nunberg
*Assistant Examiner*—Kenneth J. Dorner
*Attorney, Agent, or Firm*—Gravely, Lieder & Woodruff

[57] ABSTRACT

A door is provided with an air-operated lock including a base structure mounted on the door adjacent the free vertical edge thereof, a bolt pivoted on the base structure for movement between retracted and extended positions, and an air cylinder between the base structure and the bolt for moving the bolt to its extended position. The air line from the lock passes from the door to the frame through a hinge capable of transmitting pressurized air.

9 Claims, 6 Drawing Figures

ENTRY STRUCTURE AND AIR-OPERATED LOCK THEREFOR

BACKGROUND OF THE INVENTION

This invention relates to entry structures and more particularly to an entry structure having an air-operated door lock.

Many commercial and public buildings, such as large office buildings, schools, and the like, are used primarily during business hours and afterwards are locked to prevent unauthorized entry. To reduce the cost of security, it is desireable to have the locks on the exterior doors of these buildings operated remotely from a single location. The same is true of the locks on interior doors at critical locations within the buildings.

Doors formed primarily of glass are found quite commonly in large commercial and public buildings, and doors of this nature usually have extruded aluminum rails surrounding and supporting the glass. One of the rails usually contains a lock, the bolt of which projects into a keeper on a door frame or on another door. Locks of this nature are in most instances operated at the door by a key and when so operated project a dead bolt into the keeper.

Attempts have been made to operate such locks electrically, but this usually requires high voltages and currents in the circuitry leading to the lock. Many building codes, however, place severe limitations on the amount of electrical power that may be transmitted through a door. For example, Underwriters Laboratories will not approve any door mounted appliance which requires more than 100 volt-amperes. Moreover, if the electrically operated locks utilize a screw to move the bolt, as is sometimes the case, an electrical failure will leave the lock in the position it was at the time of the failure, since screw-type drive mechanisms are not reversible. This may create a safety hazard, assuming the electrical failure occurs when the bolt is projected into its keeper.

SUMMARY OF THE INVENTION

One of the principal objects of the present invention is to provide an air-operated lock for doors. Another object is to provide an air-operated lock of the type stated which is compact and can fit in the vertical rails of doors formed primarily of glass. Another object is to provide a remotely controlled lock which is operated without transmitting electrical power through a door. An additional object is to provide a lock of the type stated which will release the door when the supply of pressurized air to it is interrupted so that the door will become unlocked in an emergency situation which impairs the air system.

The present invention is embodied in a lock including a base structure, a bolt, and a fluid cylinder for operating the bolt. It is also embodied in the overall entry structure of which the lock is a component. The invention also consists in the parts and in the arrangements and combinations of parts hereinafter described and claimed.

BRIEF DESCRIPTION OF THE DRAWINGS

In the accompanying drawings which form part of the specification and wherein like numerals and letters refer to like parts wherever they occur.

DETAILED DESCRIPTION OF THE EMBODIMENTS

Figure 1:
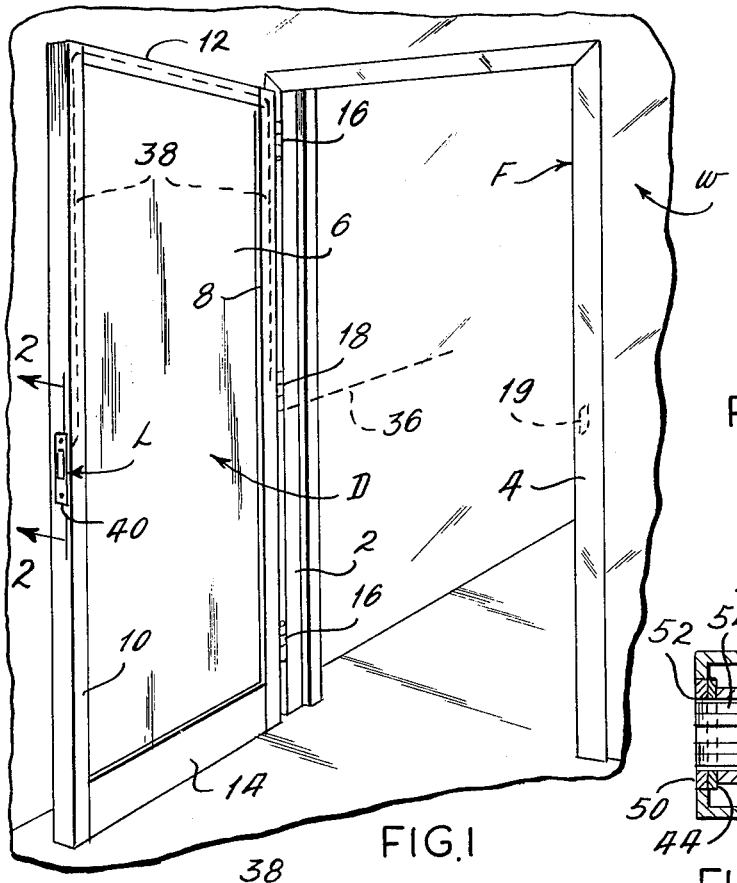
FIG. 1 is a perspective view of an entry structure constructed in accordance with and embodying the present invention.

Referring now to the drawings (FIG. 1) a wall W contains a door frame F which defines an opening through the wall W. The door frame F has hinge and strike jambs 2 and 4, respectively, and carries a swinging door D which includes large panes of glass 6 bordered on their sides by vertical rails 8 and 10 and capped on their ends by upper and lower rails 12 and 14. The rails 8, 10, 12 and 14 are hollow aluminum extrusions which are joined together at their ends to form a rigid frame for the glass 6. The vertical rail 8 is adjacent the hinge jamb 2 and is secured to that jamb by hinges 16 and 18. The hinges 16 are conventional full mortise-hinges, while the hinge 18 is a so-called air hinge capable of transmitting pressurized air through it. The vertical rail 10 contains a lock L which is operated by pressurized air transmitted through the air hinge 18. When the lock L is actuated by pressurized air, it engages a strike or keeper 19 on the strike jamb 8 and secures the door D on the frame F.

Figure 5:
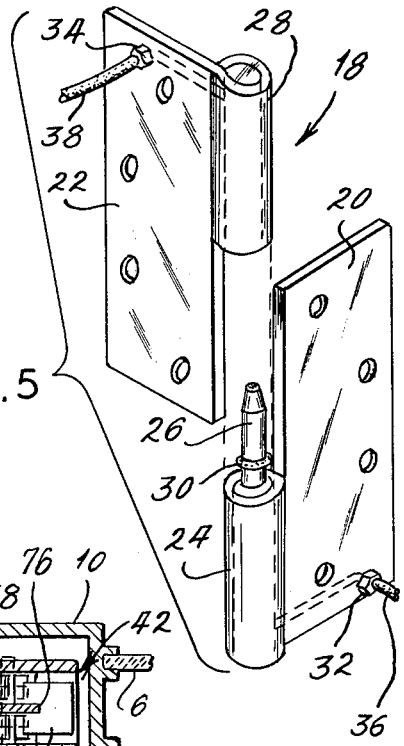
FIG. 5 is an exploded perspective view of an air hinge used in the entry structure.

The hinge 18 (FIG. 5), while being a full mortise hinge, is of the loose pin variety and has two leaves 20 and 22, the former of which is attached to the hinge jamb 2, while the latter is attached to the vertical rail 8 of the door D. The leaf 20 has a knuckle 24 from which a hinge pin 26 projects upwardly. The leaf 22 has a knuckle 28 which receives the hinge pin 26 and rests on the knuckle 24. An air-tight seal is established between the pin 26, and the knuckle 28 by an O-ring 30 which embraces the pin 26. The leaf 20 contains an air channel which extends from a hose fitting 32 on the back side thereof traversely through the leaf 20, the knuckle 24, and thence through the hinge pin 26 which is hollow. Likewise the leaf 22 contains an air channel which extends from the knuckle 28 thereof transversely through the leaf to a hose fitting 34 on the back side of the leaf 22. Thus, the two hose fittings 32 and 34 are in communication through the hinge 18 irrespective of the position of the door D within the door frame F. The hose fitting 32 projects into the hinge jamb 2 where it is connected to an air line 36 located in the wall W. The air line 36 is connected with a source of pressurized air and has a solenoid valve (not shown) in it for interrupting the flow of air to the hinge 18. When the flow is interrupted, the valve further vents the portion of the air line 36 located beyond it. The solenoid valve is controlled from a remote location such as a security office in the building. The hose fitting 34 on the leaf 22 projects into the vertical rail 8 where it is connected to a flexible air line 38 which extends through the rail 8, the upper rail 12, and the other vertical rail 10 to the lock L. The air hinge 18 is more completely described in U.S. Pat. No. 3,872,541 entitled HINGE CAPABLE OF TRANSMITTING PRESSURIZED AIR.

Figure 4:
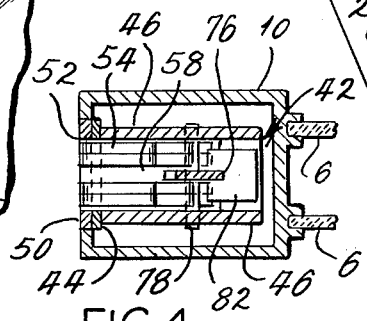
FIG. 4 is a sectional view taken along lines 4—3 of FIG. 2.

The lock L fits into the vertical rail 10 through an elongated rectangular cutout 40 in that wall of the rail 10 which is presented toward the strike jamb 4. The lock L, includes (FIGS. 2 – 4) a base structure 42 comprises of a front plate 44 and a pair of parallel side plates 46 which are secured firmly to the front plate 44 by staking or some other procedure. The base structure 42 is secured in place by machine screws 48 which pass through the front plate 44 and extend all the way to and thread into the opposite wall of the vertical rail 10, that is the wall on the opposite wall of the rail 10 from the wall containing the cutout 40. When the base structure 42 is so disposed the rear edges of its side plates 46 abut against opposite wall of the rail 10, while the front plate 44 is located immediately behind the cutout 40. The front plate 44 is covered by a face plate 50 which occupies the cutout 40 and has its exposed face flush with the exposed face of the vertical rail 10. Surrounding the screws 48 are compression-type coil springs which urge the base structure 42 away from the back wall of the rail 10 and keep the lock L from rattling if the screws 48 work loose. Both the front plate 44 and the face plate 50 have rectangular apertures 52 which are in marginal registration.

The space between the two side plates 46 contains a pivot bolt 54 which is exposed through the apertures 52 in the face plate 50. The bolt 54 pivots between retracted and extended positions on a pin 56 which bridges the side plates 46 and is located closer to the upper end of the rectangular aperture 52 than to the lower end. In its retracted position (FIG. 2) the bolt 54 remains generally flush with the face plate 50 and is contained entirely within the rail 10. When in the extended position (FIG. 2*a*) the bolt 54 projects beyond the rail 10, and when aligned with the keeper 19 in the strike jamb 4, it will engage that keeper to secure the door O. The bolt 54 is a laminated structure with the laminations extending parallel to the side plates 46. All of the laminations except the centermost are the same size and shape. The centermost lamination is somewhat shorter than the other laminations so as to create an upwardly opening slot 58 (FIGS. 3 & 4) in the bolt 54. On each side of the center slot 58, the remaining laminations are provided with oblique grooves 60 (FIG. 2) which open generally upwardly and away from the front plate 44.

Also mounted between the side plates 46 is an air cylinder 62 which operates the pivot bolt 54, moving that bolt from its retracted position to its extended position when actuated. The air cylinder 62 includes (FIGS. 2 and 3) a barrel 64 having a top plate 66 which forms a cap for the upper end of the barrel 64. Moreover, the plate 66 projects toward front plate 44 and installed between this portion of the plate 66 and the cylindrical wall of the barrel 64 is a gusset 68 through which a mounting pin 70 projects. The ends of the pin 70 are anchored in the side plates 46 of the base structure. The plate 66 also has a hose fitting 72 which communicates with the interior of the barrel 64 and this fitting connects the barrel 64 with the air line 38. In addition to the barrel 64, the air cylinder 62 also includes a cylindrical piston 74 which extends into the barrel 64 and projects from the lower end thereof. The piston 74 merges into a narrow actuating arm 76 which projects downwardly into the slot 58 in the bolt 54. The arm 76 carries a cross pin 78 which is pressed into it and extends laterally from the slot 58 into the oblique grooves 60 of the bolt 54. The ends of the pin 78 are received in vertical slots 80 (FIGS. 2 and 2*a*) located in the side plates 46 of the base structure 42. The slots 80 constitute a guide path for the cross pin 78. Hence, when the piston 74 extends from the barrel 64, the cross pin 78 moves through the vertical slots 80 and in so doing causes the bolt 54 to move to its extended position (FIG. 2*a*).

Projected rearwardly from the actuating arm 76 is a stop tab 82 which moves downwardly toward a stop rod 84 when the piston 74 extends from the barrel 64. Indeed, the tab 82 abuts the end of the stop rod 84 when the pivot bolt 54 is fully extended. The lower end of the stop rod 84 is anchored in a bracket 86 which is secured to the two side plates 46. The bracket 86 permits adjustment of the stop rod 84 upwardly and downwardly so that the extension of the piston 76 from the barrel 74 can be adjusted. The stop rod 84 is hollow (FIGS. 2*a* and 3) and receives a guide rod 88 which is carried by and projects downwardly from the tab 82. The aligned stop rod 84 and guide rod 88 are surrounded by a compression-type coil spring 90, the ends of which bear against the bracket 86 and the stop tab 82. Hence, the spring 90 urges the piston 74 into the barrel 64. The return force exerted by the spring 90 is supplemented by tension spring 92 extended between the piston 74 and the top plate 66.

OPERATION

During business hours, the solenoid valve in the air line 36 is closed so that the portion of the air line 36 beyond it is vented and likewise so is the air line 38 and the barrel 64 of the air cylinder 62. Consequently, the spring 90 forces the piston 74 to and maintains it in its fully retracted position in the barrel 64, and the pivot bolt 54 likewise assumes its fully retracted position. In this connection, it should be noted that since the pivot pin 56 for the bolt 54 extends through the upper portion of the bolt 54, gravity tends to cause the bolt to assume its retracted position. Moreover, the inclination and shape of the grooves 60 are such that the cross pin 78 remains in them.

Whenever it is desired to secure the door D, such as after business hours, the solenoid valve is opened by merely operating the switch at the remote location. When so opened, the air line 36 within the wall W, the air channels through the air hinge 18, and the air line 38 within the door D are all pressurized. Since the air line 38 is connected with the barrel 64 of the air cylinder 62, the barrel 64 is also pressurized. The increase in pressure within the barrel 64 drives the piston 74 downwardly against the force exerted by the spring 90. As a result, the spring 90 is compressed and the cross pin 78 moves downwardly through the vertical slots 80 in the side plates 46 of the base structure 42. Inasmuch as the cross pin 78 extends through the oblique grooves 60 in the pivot bolt 54, a downwardly directed force is applied to the pivot bolt 54 rearwardly from the pivot pin 56, and this force causes the bolt 54 to pivot about the pin 56. As a result, the lower end of the bolt 54 moves out of the rectangular apertures 52 in the front plate 44 and face plate 50, and the bolt 54 assumes its extended position (FIG. 2*a*). In this regard, the piston stops when the stop tab 82 comes against the end of the stop rod 84. When the tab 82 is so disposed, the bolt 54 is in its fully extended position.

Assuming that the door D is closed when the air cylinder 62 is pressurized, the bolt 54 will project into the keeper 19 on the strike jamb 4 and will secure the door D in the frame F. To render the solenoid valve inoperable, except when the door D is closed so as to insure that the bolt 54 projects into the keeper 19, the solenoid valve may be further controlled by a Switch Hinge such disclosed in U.S. Pat. No. 3,715,537.

Figure 2:
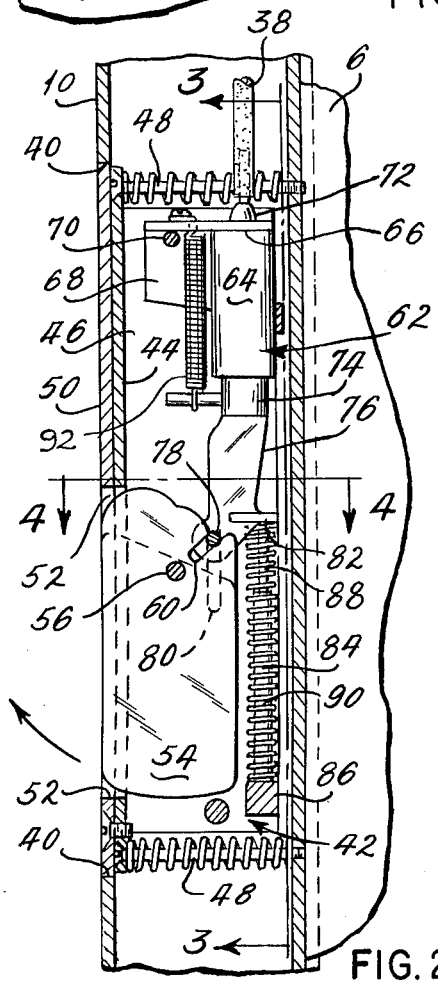
FIG. 2 is a sectional view taken along lines 2—2 of FIG. 1 and showing the air-operated lock of the entry structure in section and with its bolt retracted.
Figure 2A:
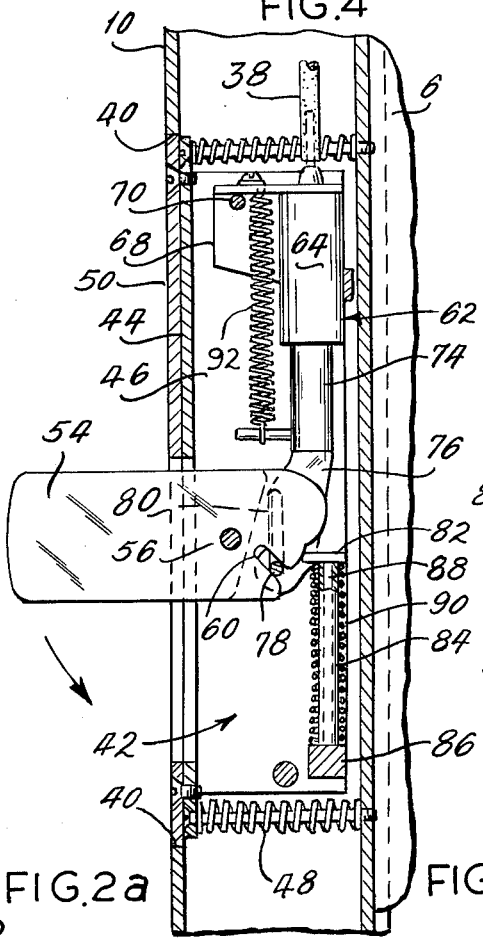
FIG. 2*a* is a view similar to FIG. 2 but showing the lock with its bolt extended.
Figure 3:
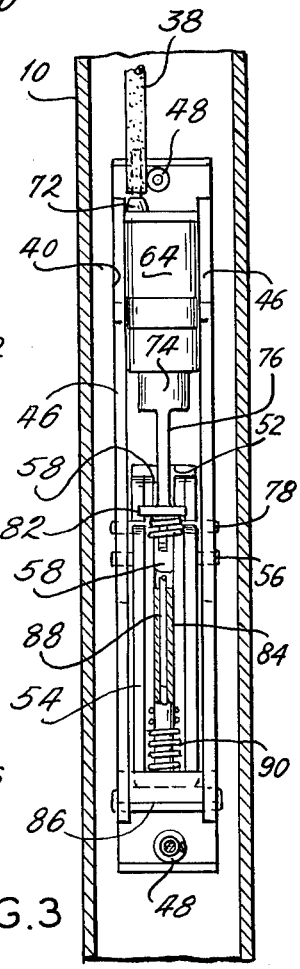
FIG. 3 is a sectional view taken along lines 3—3 of FIG. 2 and showing the back of the lock.

Should an electrical failure occur, the solenoid valve will be de-energized and will vent the air lines 36 and 38, permitting the spring 90 to move the bolt 54 back to its retracted position (FIG. 2). Hence, the lock L will not trap anyone in the building in the event of a fire or some other situation which disrupts the electrical service.

Since most large commercial and public buildings have air compressors to supply pressurized air for various appliances throughout the building, utilization of the lock L does not significantly increase the cost of construction or operation.

What is claimed is:

1. In an entry structure including a door frame having a first elongated member, a door which is hinged on and moves between open and closed positions with respect to the door frame and has a second elongated member which is located opposite and in close proximity to the first elongated member of the door frame when the door is closed, the improvement including an improved lock for securing the door in its closed position, said lock comprising: a base structure mounted in a fixed position on the second elongated member; a bolt pivoted on the base structure for rotational movement between extended and retracted positions about an axis fixed in position with respect to the base structure, the bolt when in its retracted position being located substantially entirely within said second elongated member so as not to interfere with the first elongated member whereby the door may be moved to its open position, the bolt when in its extended position being projected laterally out of and beyond said second elongated member for engagement with a retaining device on the first elongated member, whereby the door is secured in its closed position, the bolt having a groove therein which is offset from the pivot axis for the bolt; a fluid cylinder mounted on the base structure with its axis generally parallel to the longitudinal axis of the elongated members and carrying a cross pin which extends crosswise with respect to the cylinder axis and moves parallel to the cylinder axis when the cylinder is energized, the cross pin further being received in the groove of the bolt so that when the cylinder is energized, a torque will be applied to the bolt and the bolt will rotate; and guide means on the base structure for confining the cross pin to a predetermined path which is generally parallel to the axis of the cylinder; the improvement further comprising transfer means for transmitting pressurized fluid from the door frame to the door to operate the lock on the door; a first fluid line extending between a source of pressurized fluid and the transfer means; and a second fluid line extending between the transfer means and the fluid cylinder of the lock.

2. The arrangement according to claim 1 wherein the transfer means comprises a hinge having a first leaf on the door frame and provided with a fluid channel connected to the first fluid line, a second leaf on the door and provided with a fluid channel connected to the second fluid line, and a hinge pin connecting the leaves so that the leaves will pivot relative to each other as the door moves relative to the door frame, the hinge pin further being hollow and connecting the fluid channels in the two leaves.

3. A lock comprising: a rigid base structure; an elongated bolt connected to the base structure for rotational movement between extended and retracted positions about an axis of rotation which is fixed in position with respect to the base structure, the bolt when in its extended position being projected a substantial distance from the base structure but not when in its retracted position, the bolt having a groove therein which extends transversely of the bolt and is spaced from the axis of rotation; a fluid cylinder including a pair of elements which move relative to each other when the cylinder is energized, one of the elements being mounted on the base structure and the other element having a cross pin which extends parallel to the pivot axis for the bolt and is received in the groove of the bolt so that when the fluid cylinder is energized the other element will move and a torque will be applied to the bolt, causing the bolt to rotate; guide means on the base structure for confining the cross pin to a path which is substantially straight and parallel to the axis of the cylinder as the other element moves, the path being generally parallel to the longitudinal axis of the elongated bolt when the bolt is in its retracted position and being disposed at a substantial angle to the longitudinal axis of the bolt when the bolt is in its extended position so that the position of the pin relative to the groove in the bolt will change as the pin moves along the path; a pair of telescoping elements, the common axis of which is parallel to the cylinder axis, one of the telescoping elements being mounted on the base structure, and the other of the telescoping elements being carried by said other element of the fluid cylinder; and a coil-type compression spring encircling the telescoping elements and urging them apart to urge the elongated bolt to its retracted position.

4. A lock according to claim 3 wherein the base structure includes a front plate and parallel side plates attached to the front plate; wherein the bolt is between the side plates and is projected substantially beyond the front plate when in its extended position, but not when in its retracted position; and wherein the one element of the fluid cylinder is a barrel located between the side plates and connected to the base member and the other element of the fluid cylinder is a piston in the barrel and having an actuating arm mounted firmly thereon, the cross pin being extended through and carried by the actuating arm.

5. A lock according to claim 4 wherein the guide means are guide slots in the side plates and the cross pin extends into the guide slots so that the guide slots guide the piston as it extends.

6. A lock according to claim 3 wherein the guide means has at least one elongated slot which is parallel to the cylinder axis and the cross pin extends into the slot.

7. A lock according to claim 6 wherein the bolt has a slot which opens toward the fluid cylinder and said cross pin of said other element of the cylinder projects into the slot of the bolt.

8. A lock according to claim 3 wherein said one element of the fluid cylinder is a barrel and said other element is a piston which is received in the barrel and further is provided with an actuating arm which is substantially narrower than the bolt; and wherein the bolt has a slot midway between its sides and the groove exists on both sides of said slot, the slot in the bolt receiving the actuating arm of said other element of the fluid cylinder.

9. A lock according to claim 3 wherein the telescoping elements form a stop which prevents further movement of said other element of the fluid cylinder when the bolt reaches its fully extended position.

* * * * *